United States Patent [19]

Porcaro et al.

[11] Patent Number: 4,579,229

[45] Date of Patent: Apr. 1, 1986

[54] DRUM ACCESSORY RAIL

[75] Inventors: Jeffrey Porcaro; Paul Jamieson, both of N. Hollywood; Gary Lonsdale, Los Angeles, all of Calif.

[73] Assignee: Jeffrey Porcaro, Inc., Los Angeles, Calif.

[21] Appl. No.: 469,501

[22] Filed: Mar. 2, 1983

Related U.S. Application Data

[63] Continuation-in-part of Ser. No. 234,855, Feb. 17, 1981, abandoned.

[51] Int. Cl.[4] ..... A47F 7/00

[52] U.S. Cl. ..... 211/13; 248/166; 108/53.5

[58] Field of Search ..... 211/13, 188; 248/176, 248/439, 166, 168; 108/53.5, 55.3; 403/231, 65, 68, 71; 84/421

[56] References Cited

U.S. PATENT DOCUMENTS

| | | | |
|---|---|---|---|
| 627,170 | 6/1899 | Austin | 248/166 X |
| 1,376,593 | 5/1921 | Tuttle | 248/439 X |
| 2,863,568 | 12/1958 | Skubic | 108/53.5 |
| 3,123,021 | 3/1964 | Evans | 108/53.5 |
| 3,893,363 | 7/1975 | Cohen | 84/421 X |

FOREIGN PATENT DOCUMENTS

| | | | |
|---|---|---|---|
| 1308733 | 10/1962 | France | 248/166 |
| 122618 | 10/1927 | Switzerland | 211/13 |

*Primary Examiner*—Ramon S. Britts
*Assistant Examiner*—Sarah A. Lechok Eley
*Attorney, Agent, or Firm*—Blakely, Sokoloff, Taylor & Zafman

[57] ABSTRACT

The invention is an improved accessory support system. The system comprises a main bar supported by a plurality of support legs. The main bar is comprised of a plurality of bar members which are connected to each other by hinges that either fold or may be disassembled. The hinges are arranged such that the bar members are capable of motion in the horizontal plane such that any configuration of the bar members around a central area may be obtained. The accessory support system may also be fabricated so that it is one piece that can fold up into a compact size for easy storage and portability. The legs are adjustable for height and the bar members can be various sizes and shapes. In addition, additional bar members may be added to extend or reconfigure the accessory support system.

The legs may each have a base plate to secure the legs to a positional reference member such as a riser at preselected positions such that the exact configuration of the accessory support system can be reproduced.

6 Claims, 16 Drawing Figures

Fig. 1
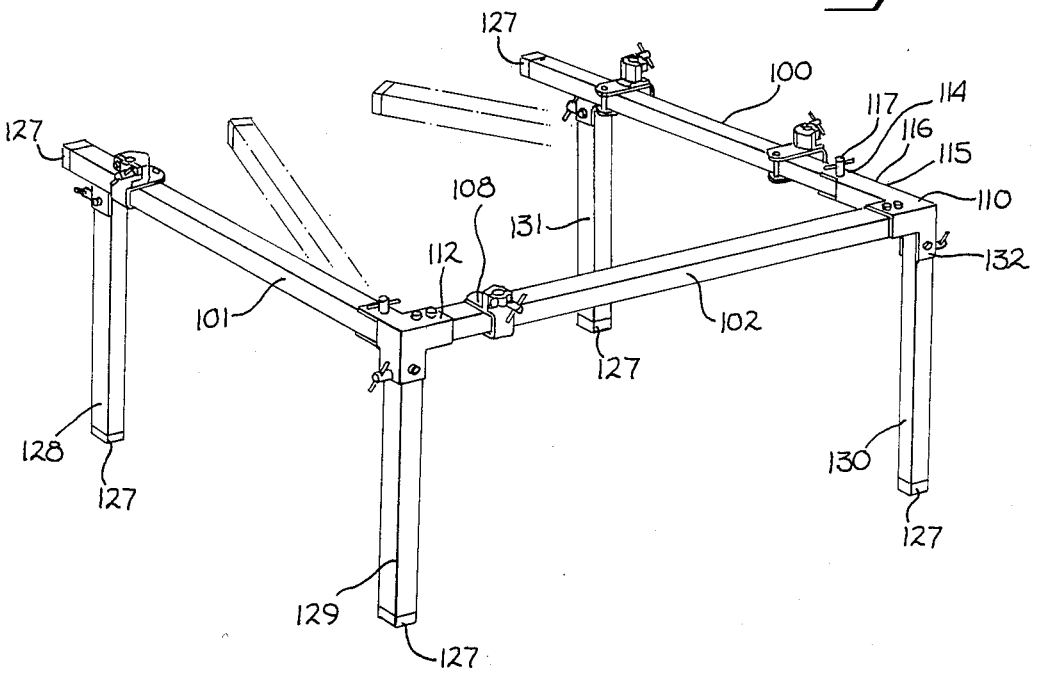
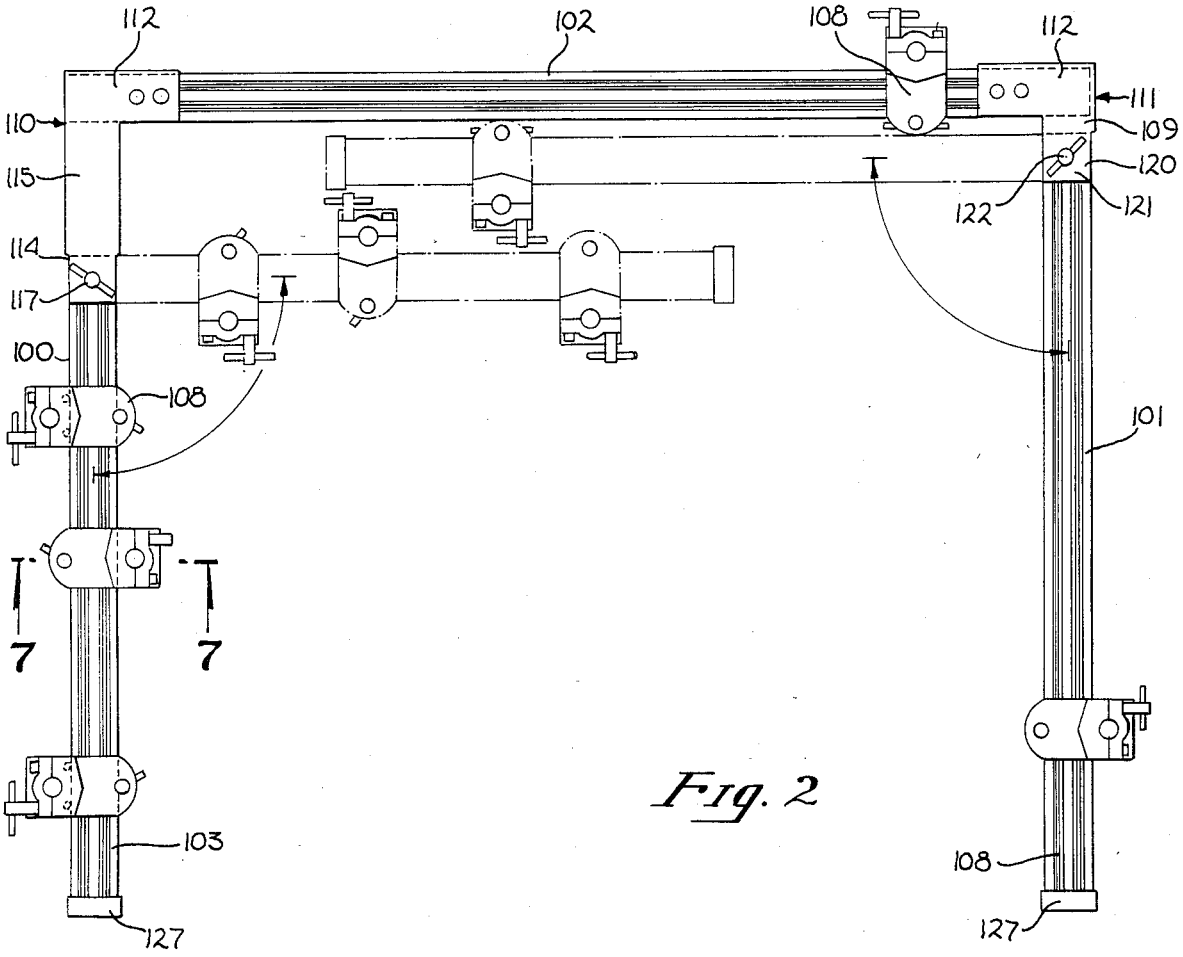
Fig. 2

DRUM ACCESSORY RAIL

This application is a continuation-in-part of an earlier filed application entitled "Drum Accessory Rail", Ser. No. 234,855, filed Feb. 17, 1981, now abandoned.

BACKGROUND OF THE INVENTION

1. Field of the Invention

The invention relates to portable, easily assembled support structure for supporting musical instruments and the like.

2. Prior Art

When a musical group performs, they may use many thousands of pounds of instruments and other performance related gear on stage during a performance. Such performance related gear includes speakers, amplifiers, and support structures to position and contain the various instruments. The support structures are particularly useful to a drummer in a group such that it usually surrounds the drummer with his drums, cymbals, microphones, etc.

There are a variety of such support structures known in the prior art. One such support structure is taught in U.S. Pat. No. 3,945,291 issued Mar. 23, 1976 to Zickos. Zickos shows a framework for supporting a drum assembly comprising a plurality of elongated rod-like frame members whose ends are interconnected by a plurality of identical joint members. Each component of the drum assembly is supported on a rod which is in turn received within a joint member mounted intermediate the ends of one of the frame members. The construction of the joints permits the frame members to be assembled in any desired arrangement and permits universal positioning of the drum assembly. Such a system is portable, easily collapsed, and very flexible.

Another such prior art system is taught in U.S. Pat. No. 4,036,462 issued July 19, 1977 to Sheftel. Sheftel's system comprises a pair of complementary collapsible members joined by a variable length spreader member. The structure is adapted to support a plurality of musical instruments. Each collapsible member comprises a central hub having a pair of pivotally coupled legs and a coupling member adapted to receive the variable length spreader member. The structure is shaped like two letter Y's bent joined together end-to-end at their bottom ends. The structure sits very low to the floor and has apertures in each branch of the structure to receive upwardly extending mounting members for mounting the musical instruments. This system is less flexible than that of Zickos but is also portable and easily collapsed.

A system of a different nature is shown in U.S. Pat. No. 3,096,677 issued July 9, 1963 to Ryan. Ryan provides a foldable floor mat structure with prelocated stops for determining the location of the feet of instrument stands.

Support systems are typically used by rock groups on tour to facilitate quick set-up and knock-down of the instruments and accessories. In a typical drum assembly many different types and sizes of drums and cymbals are used and a microphone is generally being used with respect to each of the instruments. In order to ensure accurate reproduction of a particular sound effect produced by a drummer, the cymbals, drums and microphones should be supported and assembled in the same relationship and location with respect to one each time they are used. The more accurately relationships and locations can be reproduced by a support system, the less time required to fine tune the instruments to find the proper "sound" of the drummer's music.

In addition to the patented prior art support systems, many drummers today still use free standing cymbals and microphones which take considerable time to properly locate so as to best reproduce a desired sound effect.

Therefore, a new and improved accessory bar support system that is lightweight, portable, easy to set up and affix instruments to would be of great advantage in the art. Further, an accessory bar system that provides reproducibility of the sound that a particular group of instruments makes would aid musicians in saving time in preliminary fine tuning of the group of instruments prior to a concert.

SUMMARY OF THE INVENTION

The invention is an improved accessory support system. The system comprises a main bar supported by a plurality of support legs. The main bar is comprised of a plurality of bar members which are capable of motion in the horizontal plane such that any configuration of the bar members around a central area may be obtained. The bar and support legs may be interconnected by hinges so that the system can be folded into a compact size for easy storage and portability or the bar members and support legs may be connected by sleeves so that the system can be disassembled for storage. The support legs are adjustable for height and the bar members can be various sizes and shapes. In addition, additional bar members may be added to extend or reconfigure the accessory support system.

The legs may each have a base plate to secure the legs to a positional reference member such as a riser at preselected positions such that the exact configuration of the accessory support system can be reproduced.

BRIEF DESCRIPTION OF THE DRAWINGS

FIG. 1 is a perspective view of the preferred embodiment of the present invention.

FIG. 2 is a top view of the frame of the preferred embodiment of the accessory support system in its folded and opened position.

DETAILED DESCRIPTION OF THE INVENTION

Figure 3:
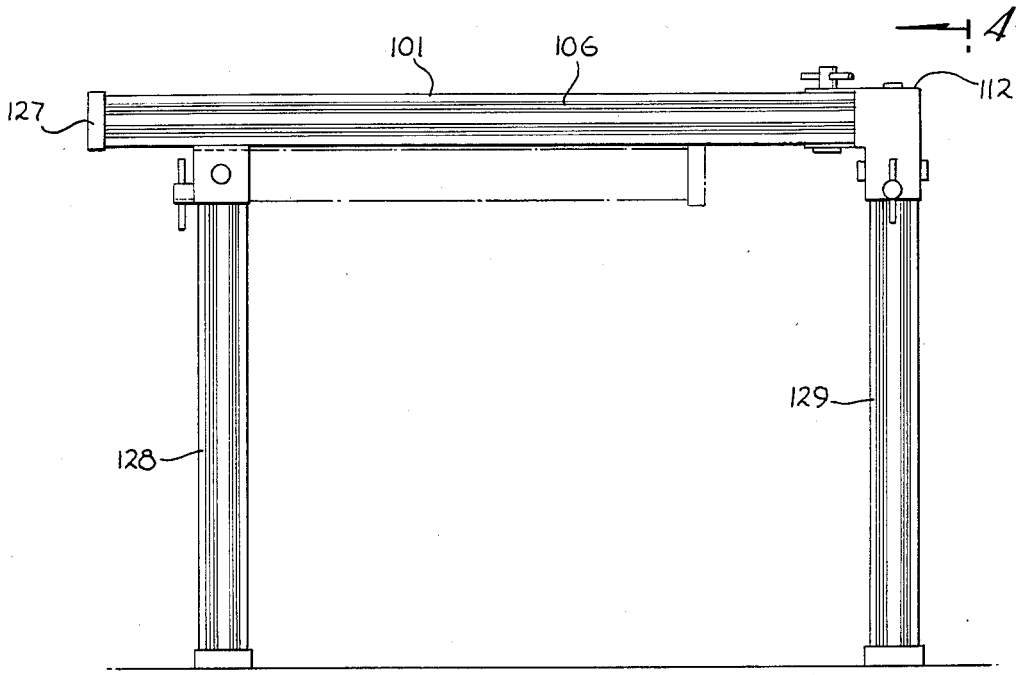
FIG. 3 is a side view of the preferred embodiment showing the present invention illustrating the leg that supports the right bar member in its folded and opened position.
Figure 4:
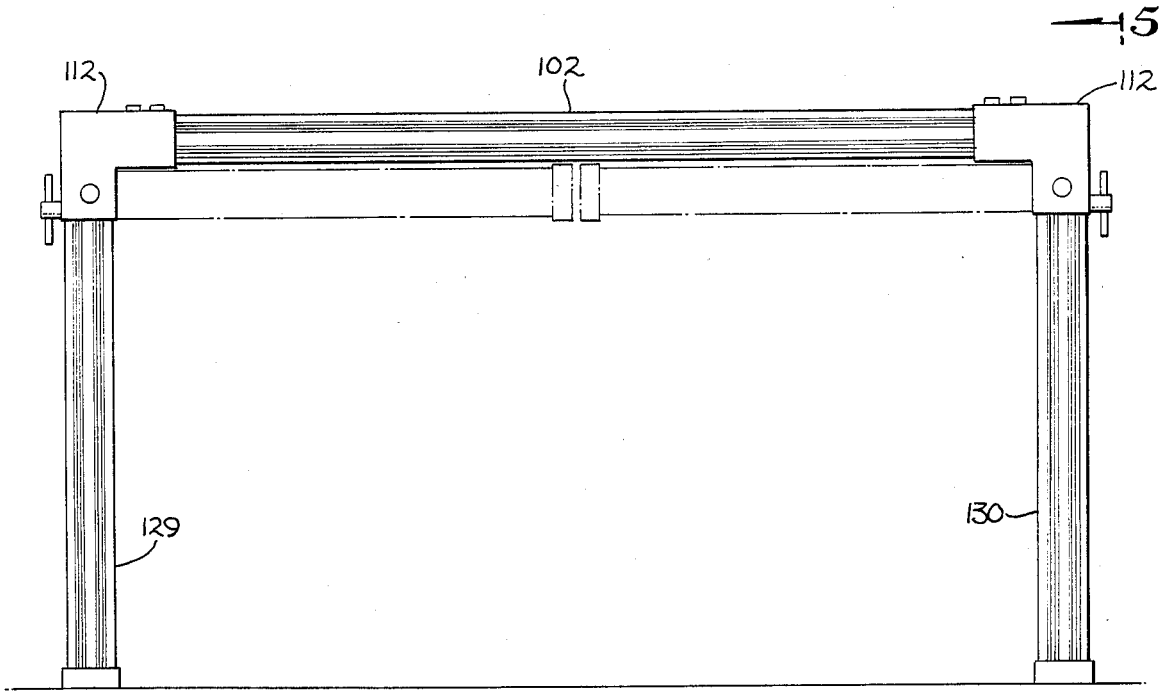
FIG. 4 is a frontal view of the preferred embodiment of the present invention illustrating the legs that support the main bar member in their folded and opened position.
Figure 5:
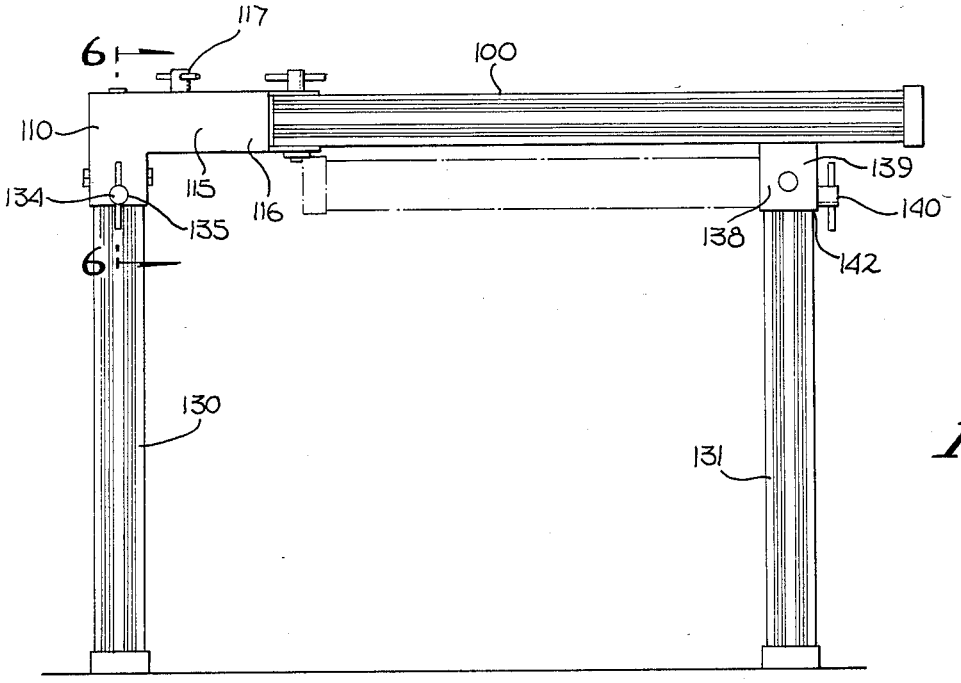
FIG. 5 is a side view of the preferred embodiment showing the present invention illustrating the leg that supports the left bar member in the folded and opened position.
Figure 6:
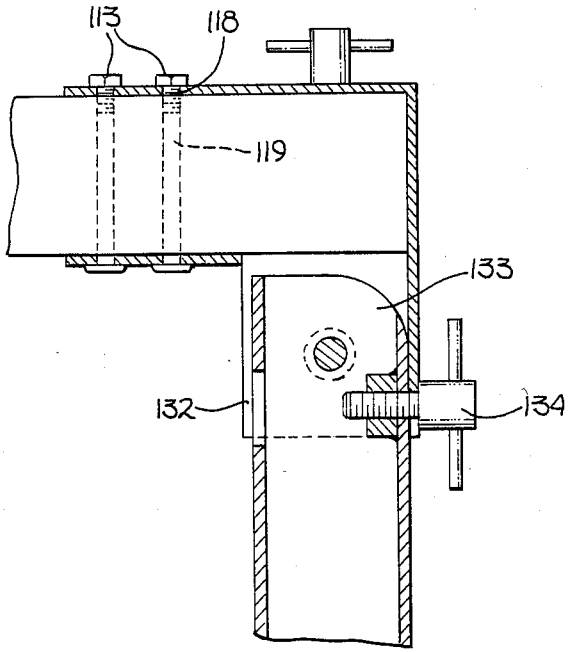
FIG. 6 is an illustration of the hinge taken along lines 6—6 of FIG. 5.

Referring first to FIGS. 1 through 7, the preferred embodiment of the accessory support system is shown. The preferred embodiment is a frame comprising at least a left and a right bar member 100 and 101 interconnected to a main bar member 102, the frame resting on a plurality of support legs 128, 129, 130 and 131. Each bar member and leg has a first and second end, a top and bottom surface, and two sides. Each surface of the bar member and legs are grooved such as shown in FIG. 3. The grooves 106 provide a better surface for a holder 108 (shown in FIG. 7) to clamp to such that the holder 108 will not slip once affixed to a bar member. The main bar member 102 is preferably a lightweight rectangular tube cut from an aluminum extension. However the bar member can vary in size, shape, weight and material that may be used.

On each end of the main bar member 102 is an L-shaped elbow hinge 110 and 111 which receive the ends 114 and 120 of the left and right bar members respectively. The first arms 112 of the L-shaped hinges are affixed to the main bar member 102 by a plurality of bolted screws 113 extending through the hinge and through the top and bottom surfaces of the main bar member 102. The L-shaped hinges 110 and 111 have a substantially U-shaped rectangular cross section which clamps onto the top, side and bottom surfaces at each end of the main bar member 102.

The left and right bar members are affixed to the main bar member via the hinges 110 and 111. One end 114 of the left bar member 100 is inserted into the cantilevered sides of the second arm 115 of hinge 110 proximate its end 116 and is attached thereto by means of a carriage bolt which is inserted through a square hole 118 in the hinge which receives the square portion of the carriage bolt to prevent rotation and through aligned holes 119 in the top and bottom surface of the bar member 100. The bolt is loosely fastened at the bottom by means of a wing nut 117. The bar member 100 is able to pivot about the carriage bolt as shown in FIG. 2. One end 120 of the right bar member 101 is inserted between the cantilevered sides of upper arm 109 of hinge 111 proximate its end 121 and is attached thereto by means of a carriage bolt which is inserted through a square hole in the hinge 111 and through aligned holes (not shown) in the top and bottom surfaces of the bar member 101. The carriage bolt is fastened at the bottom by means of a wing nut 122. Bar member 101 is able to pivot about the carriage bolt. When the desired configuration of the left and right bar members 100 and 101 are obtained by rotating the members about the carriage bolts, the wing nuts 117 and 122 are tightened to clamp the cantilever sides of the hinges together.

In the preferred embodiment, hinges 110 and 111 have different length upper arms 115 and 109 in order that the bar members can be compactly folded up next to the main bar member 102 when not in use. Thus, the left bar member 100 will fold so that it is next to the main bar member 102, while the right bar member 101 will wrap around the left bar member 100 as shown in FIG. 2. The uncoupled ends 103 of bar members 100 and 101 may either be attached to additional bar members if additional structure is required for affixing accessories, or to protective shoes 127.

Once the bar members 100, 101 and 102 which comprise the frame of the accessory support system are affixed into the desired configuration, support legs 128, 129, 130 and 131 are affixed thereto to support the frame. Hinges 110 and 111 have a third U-shaped arm 132 at a right angle to the upper and lower arms for receiving one end 133 of the support legs 129 and 130. Each end 133 is affixed to its respective third arm 132 by a pivot bolt 134 which allows the leg to rotate 90°. At the lower end of third arm 32 is a groove 135 for receiving a wing bolt 134 to lock the leg in place. Thus when the leg is in the full 90° assembled position, the wing bolt 135 is tightened to keep the leg upright to support the frame. Any other suitable mechanism for attaching the support legs to the frame may be substituted in lieu of the folding locking mechanism on hinges 110 and 111.

Support legs 128 and 131 are affixed to left and right bar members 100 and 101 respectively by a foldable locking mechanism. Specifically, hinges 137 and 138 are fixedly mounted to the bottom surface of bar members 100 and 101 respectively proximate their unattached ends 139. A bolt 140 is inserted through each hinge and through each respective bar member so as to allow the bar members to rotate 90°. When the leg is in the full 90° assembled position, a wing bolt 140 is tightened into a groove 142 in hinges 137 and 138 to keep the legs in place. Any other suitable locking mechanism to affix the legs to the bar members may be substituted in lieu of the hinges 110 and 111.

Each of the legs may be adjustable for height. For example, each of the legs may be a single piece such as shown in FIG. 1, or telescoping pieces or tripod based if adjustable length is desired.

The assembly may also be affixed to a riser such as riser 15 discussed with respect to the alternate embodiment of the invention describes below with reference to FIG. 8 or may be free standing. If it is free standing, the bottom of the support legs are fitted with rubber shoes for added traction so that the assembly will not slip on the stage during use.

Figure 7:
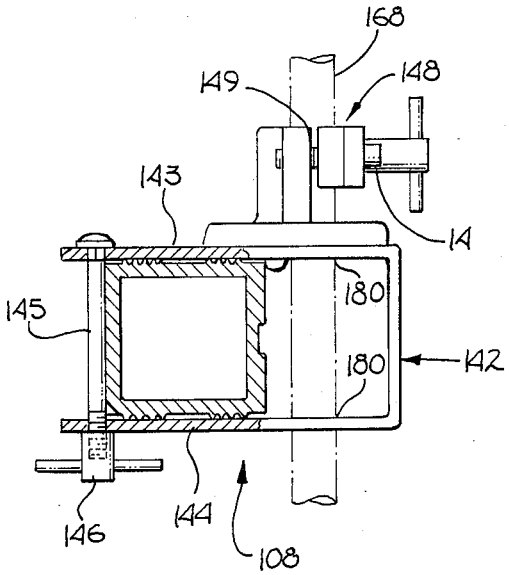
FIG. 7 is a cross section of the holder affixed to a bar member taken along lines 7—7 of FIG. 2.

In the preferred embodiment of the invention, the accessories are affixed to the bar members by means of holder 108 comprised of sliding U-shaped clamps 142 shown in FIGS. 2 and 7 which are adjustable to any position on the bar. The clamp 142 is affixed to a bar member by inserting it around the bar member such that a first arm 143 is over one surface of the bar member and a second arm 144 is under the parallel surface. Once the clamp 142 is inserted around the bar member at the desired location, the arms 143 and 144 are tightened around the bar member by a bolt 145 which is placed through the top and bottom arms 143 and 144 and wing nut 146. Clamp 142 has holes 180 extending through arms 143 and 144 proximate the U-shaped end through which a mounting rod 168 affixed to the accessory to be supported is inserted. For additional support, a holder 148 may be affixed to the U-shaped clamp 142 directly over the holes to hold the mounting rods 168 in place as shown in FIGS. 2 and 7. The holder may be a clamp 149 having a middle section which is fastened at one side by a pivot bolt which adjusts for various diameter mounting rods and a bolt fastened by a wing nut to tighten the clamp 149 around the mounting rod. In the alternative, drilled holes may be made in the bar members through which the mounting rods are inserted.

Figure 8:
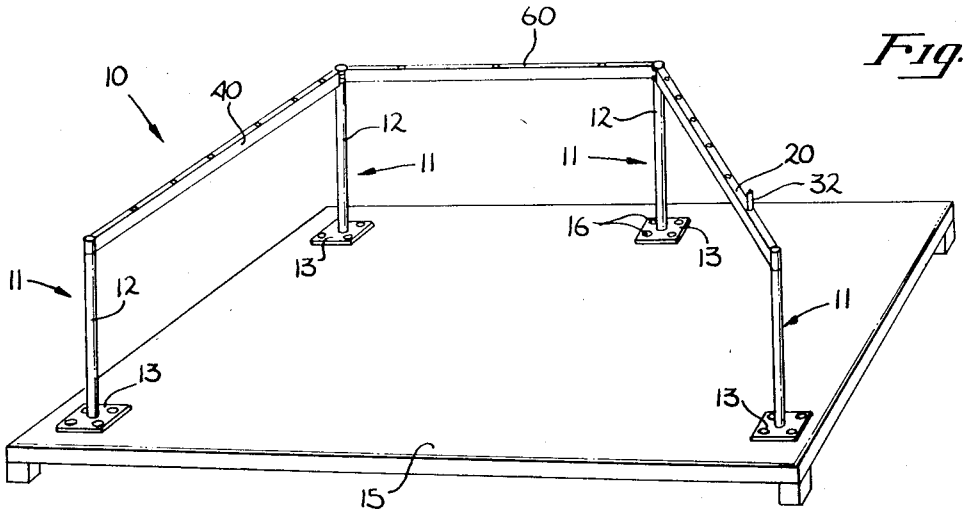
FIG. 8 is a perspective view of a second embodiment of the assembled accessory support system of the present invention.

The second embodiment of the accessory support system of the present invention is illustrated in FIG. 8 and is comprised of four support members 11. Each support member comprises a vertical column 12 and a base plate 13. The supports 11 may be located in any desired configuration, however it has been found that the most comfortable configuration for a drummer to use is that of a generally square shaped C. Therefore, the supports are placed on a riser 15 in a trapezoid configuration such that each support is at one corner of the trapezoid. The supports are then interconnected by three bar members such as the right side bar 20, the left side bar 40 and the middle bar 60. Musical instruments and microphones are secured onto these bar members by suitable connection means. The interconnected support members 11 and bar members are secured to the riser 15 as shown in FIG. 3.

The column 12 of each support member 11 is typically a steel tube approximately 28 inches long and 1 and $\frac{5}{8}$ inches in diameter. The base plate 13 may also be made of steel approximately 7 inches square and approximately $\frac{1}{8}$ inch thick. Column 12 is welded to the center of the base plate 13.

A number of holes 14 are provided in the base plate 13 to secure the support member 11 to the riser 15 in the desired configuration. A bolt 16 is inserted through the holes 14 in the base plate 13 and through the corresponding holes 17 in the riser 15. A nut 18 is secured to one end of the bolt 16 to firmly anchor the base plate 13 and vertical column 12 to the riser 15. By securing the support member 11 to the riser 15 and physically arranging the support members 11 in a generally C-shaped configuration ensures that the bar support system 10 has a high degree of stability and rigidity. Thus, the system will not tip over when the musical instruments and related accessories are affixed thereto.

Figure 9:
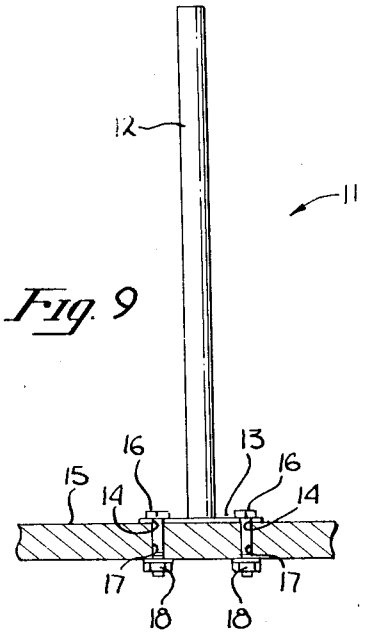
FIG. 9 is a side view of a support mounted to a riser as employed in the second embodiment of the present invention.

Referring next to FIG. 9, an alternative method of mounting a support 11 to a rise 15 is shown. The riser 15 has a hole 80 therein which is generally of the same shape and size as the column member 12. The hole 80 is prepositioned in the rise such that when the supports 11 are inserted therein, the desired configuration of the accessory support system will be obtained. In addition, a plurality of holes 17 are provided around the hole 80.

A cup shaped member 82 having a flange shaped rim is affixed to the bottom of riser 15 by inserting bolts 16 through and the holes 86 in the rim 84 which are secured by nuts 18 the holes 17 in the riser. The column member 12 may be placed in the hole 80 in riser 15 into the cup 82 and thereby securely mounted in the location of the prepositioned hole 80.

The advantage of this alternate method is that the bolts 16 do not have to be removed and reinserted each time that the bar support system 10 is to be assembled or disassembled. This provides a significant decrease in the amount of time necessary to assemble or disassemble the bar support system.

After each of the support members 11 has been secured to the riser 15, the various bar members are affixed to the free ends of the support members 11, to form the generally C-shaped configuration of the bar support system 10.

Figure 10:
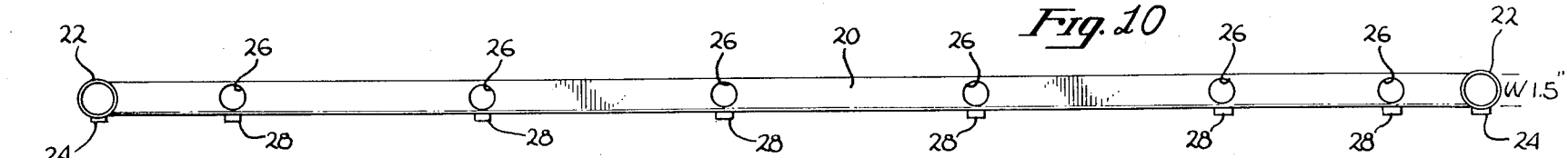
FIG. 10 shows an alternate method of mounting a support to the riser.
Figure 11:
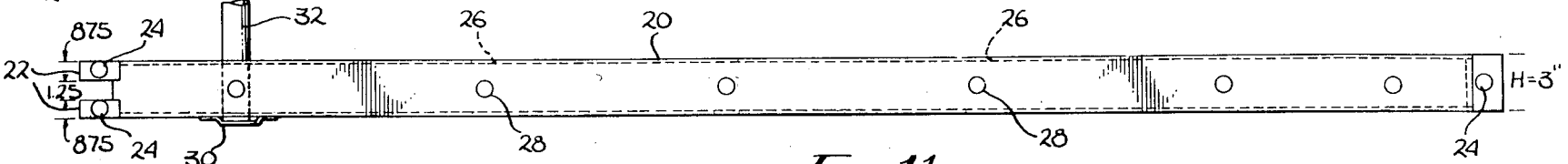
FIG. 11 is a top view of a right side bar member.
Figure 12:
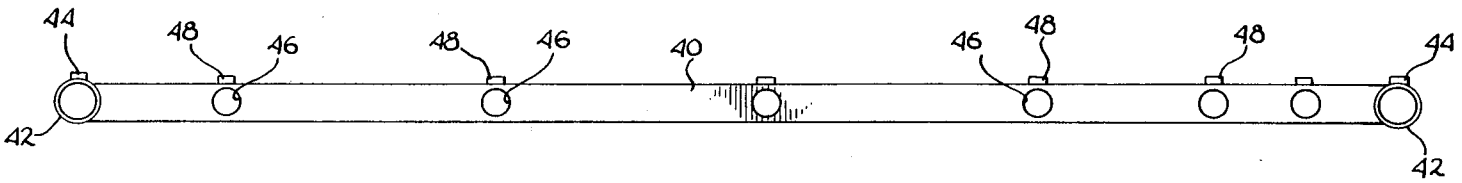
FIG. 12 is a side view of the right side bar member.

A right side bar 20 is illustrated in FIGS. 10 and 11. The right side bar 20 is typical of the other bar members. The bar is constructed of sheet steel having a rectangular cross section approximately 1 and $\frac{1}{2}$ inches by 3 inches. In the embodiment shown in FIG. 8, the bar is tubular.

At each end of the right side bar 20, there is a sleeve 22 through which there is a thumbscrew 24. The left sleeve 22 is comprised of two sections which are designed to interfit with a narrow single section sleeve 62 of the middle bar 60 as shown in FIGS. 10 and 11. The sleeves 22 at each end of the bar 20 are placed over the ends of support 11 on the right side of the riser 15 until it is at the desired position on the two support members. The thumbscrew is then tightened so that the bar 20 is rigidly affixed to the support members 11.

At a plurality of locations between the ends 21 and 23 of the right side bar 20 are a plurality of mounting holes 26 and cooperating thumbscrews 28. A mounting rod 32 may be secured in each one of the mounting holes 26 by inserting the rod 32 in the desired hole and tightening the thumbscrews 28. In addition to tightening the thumbscrews 28, a short, narrow steel plate 30 is welded in place across one end of a mounting hole 26 on which one end of a mounting rod 32 rests.

Figure 13:
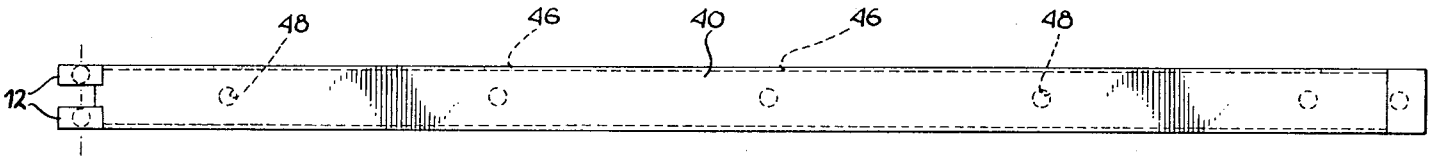
FIG. 13 is a top view of a left side bar member.
Figure 14:
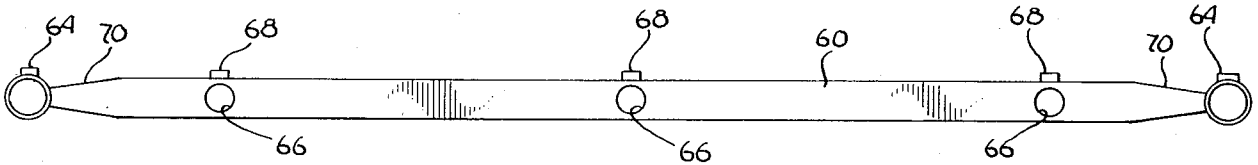
FIG. 14 is a side view of the left side bar member.

The left side bar 40 shown in FIGS. 13 and 14 is identical to the right side bar 20 except that the two-section sleeve 42 is on its right end. Thus, the left side bar 40 will interfit with the narrow single section sleeve 62 of the middle bar 60.

Figure 15:
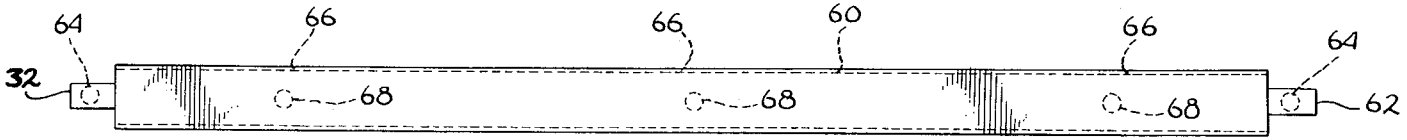
FIG. 15 is a top view of the middle bar member.
Figure 16:
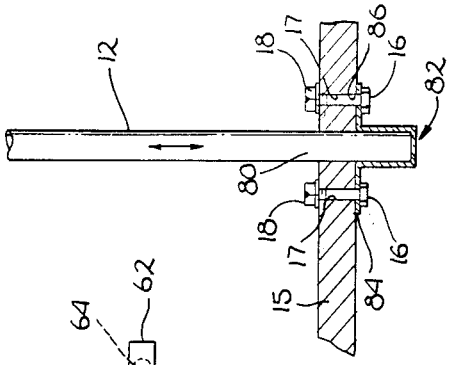
FIG. 16 is a side view of the middle bar member.

In FIGS. 15 and 16, the middle bar member 60 has a pair of sleeves 62 at each end containing thumbscrews 64 for securing the sleeves 62 in the desired position along the length of a respective support member 11. The middle bar member 60 has a plurality of mounting holes 66 in which there are a plurality of thumbscrews 68 for securing mounting rods 32 in the mounting holes 66. The sleeves 62 of the middle bar member 60 are narrow sleeves which are designed to interfit and cooperate with the two section sleeve 22 of the right side bar 20 and two section sleeve 42 of the left side bar 40. In the preferred second embodiment, the middle bar 60 may be provided with a slight taper 70 for esthetic purposes. It is, of course, contemplated that various other shapes could be used for the various elements without significantly effecting the function and operation of the various elements used in this embodiment of the invention. The accessory support system of the present invention can easily and quickly be assembled or disassembled. Once assembled in its desired configuration it is very rigid and will not tip over when the instruments and other accessories are affixed to it. The construction of the accessory support system 10 and hence the attached musical instruments in a pattern which is highly repeatable thereby decreasing the amount of time which must be spent by a performing group to ensure that the sound effects produced by a musician are accurately reproduced by being able to reproduce the exact configuration of his instruments during his last performance.

It is, of course, contemplated that similar changes and modifications could be made by one with ordinary skill in the art without departing from the spirit and scope of the present invention. It is to be understood that the above description and drawings are provided merely as a means as illustration and not as a definition of the limitations of the invention which is to be given a scope consistent with the scope and breadth of the appended claims.

What is claimed is:

1. A system for permitting musical instrument accessories secured to mounting rods to be repeatedly set-up in the same position with respect to one another comprising:

a frame including at least three bar members, provided at each end thereof with a sleeve member having an axis generally perpendicular to the longitudinal centerline of said bar members, a plurality of support means for supporting said frame at a preselected height above the floor;

said sleeve members closely fitting over one of said support means to interconnect said bar members to each other and to said support means;

wherein each sleeve member comprises a means for securing said sleeve member to any of said support means at any position along the length of said support means;

folding hinge means affixed to said bar members wherein one of said at least three bar members interconnects at each end with two other of said at least three bar members;

whereby when said folding hinge means is in an open position said plurality of bar members are coplanar and when said folding hinge means is in a closed position, said bar members fold around each other;

wherein at least one of said plurality of support means is affixed to said hinge means;

whereby said support means may be folded proximate said bar members when said system is not in use;

and wherein a plurality of mounting holes are placed in each of said bar members, and each of said mounting holes has a corresponding thumbscrew threadedly coupled thereto and cooperating with said corresponding mounting hole for securing a musical instrument accessory mounting rod;

a riser and means for mounting each of said plurality of support means onto said riser to support said frame in a fixed position.

2. The system of claim 1 wherein said means for mounting comprises a base plate rigidly affixed to one end of said support means;

said riser being provided with a plurality of communication means for communicating with a respective one of said plurality of holes in said base plate.

3. The system of claim 2 wherein said means for mounting comprises a first hole prepositioned in said riser having a size and shape approximating the cross section of said support means;

a plurality of second holes in said riser disposed about said first hole;

a cup member having a flange provided with a plurality of holes therethrough each of which is disposed for communication with a respective one of said plurality of said second holes, the mouth of said cup member being disposed for communication with said first hole;

whereby a bolt may be passed through a respective one of said second holes and a respective one of said holes through said flange and secured therein by a nut;

whereby one end of one of said plurality of support means may be passed through said first hole and into said cup and thereby mounted onto said riser in the location of said prepositioned first hole.

4. An apparatus for permitting musical instruments secured to mounting rods to be repeatedly set-up in the same position with respect to one another comprising:

a riser provided with four sets of prepositioned holes therethrough said four sets disposed in said riser to generally define the corners of a geometric configuration;

four support members having a first and second end, said second end having a base plate having a set of holes therethrough, said set of holes in said base plates being positioned for communication with a respective one of said four sets of holes disposed in said riser whereby a bolt may be passed through each hole of said set of holes in said base plates and through each hole of said four sets of holes in said riser and secured therein thereby mounting said four support members one each at each of said corners of said geometric configuration;

three bar members provided at each end thereof with a sleeve member having an axis perpendicular to the centerline of said bar members and having a size and shape for close fitting engagement over the other end of said support members each sleeve member being secured at any position along the length of a respective support member; each of said bar members being provided with a plurality of mounting holes therethrough and a respective plurality of means for securing a respective musical instrument mounting rod in each of said mounting holes, each of said securing means comprising a thumbscrew threadedly coupled to a corresponding one of said mounting holes;

folding hinge means affixed to said bar members wherein one of said bar members interconnects at each end with two other of said bar members;

whereby when said folding hinge means is in an open position said bar members are coplanar and when said folding hinge means is in a closed position, said bar members fold around each other;

the sleeve member at each end of one bar member being constructed to interfit with the sleeve member at one end of the other two bar members such that said interfitting sleeve members simultaneously pass over the other end of respective support members and said three bar members interconnect said four support members generally in the geometric configuration and are coplanar with one another.

5. A musical instrument support system for supporting musical instrument accessories at a preselected height off the floor, comprising:

a first bar member of rectangular cross-section having a first and second end and a top and bottom surface;

a second bar member of rectangular cross-section having a first and second end and a top and bottom surface;

a third bar member of rectangular cross-section having a first and second end and a top and bottom surface;

attachment means affixed to each end of said first bar member for attaching said first end of the second bar member to said first end of the first bar member and for attaching said first end of said third bar member to said second end of said first bar member, wherein said attachment means are lockable hinges affixed to said first and second ends of the first bar members and portably affixed to said first ends of the second and third bar members, respectively, wherein said hinges are L-shaped having elongated members which are offset such that the second bar member can be folded proximate the first bar member and the third bar member can be folded proximate the second bar member, whereby the second and third bar members may be folded against the first bar member and when the bar members are unfolded they have substantially a rectangular U-shape;

a plurality of support means for supporting said first, second and third bar members at a preselected height off the floor, wherein said support means are a plurality of legs;

whereby said support means may be folded proximate said first, second, and third bar members when said system is not in use and said support means may be unfolded and locked to support said system when said accessories are to be supported;

at least one holding means slidingly and removably coupled to each of said first, second and third bar members to which are attached musical instrument accessories, wherein said holding means comprises a U-shaped clamp and a bolt having a threaded end for threadedly engaging a wing nut, said bolt and wing nut passing through arms of said clamp sized to fit over a corresponding one of said bar member, said clamp having affixed thereto a second clamp for clamping one of said musical instrument accessories.

6. The musical instrument support system defined by claim 5 further comprising a riser and means for mounting each of said plurality of support means onto said riser to support said first, second and third bar members in a fixed position.

* * * * *